US006123322A

United States Patent [19]

Sasaki

[11] Patent Number: 6,123,322

[45] Date of Patent: Sep. 26, 2000

[54] SINGLE SCREW CARBURETOR

[75] Inventor: Hidenori Sasaki, Cass City, Mich.

[73] Assignee: Walbro Corporation, Cass City, Mich.

[21] Appl. No.: 09/097,956

[22] Filed: Jun. 16, 1998

[51] Int. Cl.[7] ..... F02M 19/025

[52] U.S. Cl. ..... 261/64.1; 261/35; 261/69.1; 261/DIG. 39; 261/DIG. 68; 261/DIG. 84

[58] Field of Search ..... 261/35, 64.1, 66, 261/69.1, DIG. 39, DIG. 68, DIG. 84

[56] References Cited

U.S. PATENT DOCUMENTS

| | | | |
|---|---|---|---|
| 2,733,902 | 2/1956 | Phillips | 261/DIG. 68 |
| 3,085,791 | 4/1963 | Phillips | 261/35 |
| 4,104,994 | 8/1978 | Phillips | 261/35 X |
| 4,139,580 | 2/1979 | Tuckey et al. | 261/35 |
| 5,262,092 | 11/1993 | Reeder et al. | 261/35 |
| 5,554,322 | 9/1996 | Kobayashi | 261/35 |
| 5,720,906 | 2/1998 | Yamanaka et al. | 261/35 |

FOREIGN PATENT DOCUMENTS

| | | | |
|---|---|---|---|
| 19504400 | 8/1996 | Germany | 261/35 |

*Primary Examiner*—Richard L. Chiesa
*Attorney, Agent, or Firm*—Reising, Ethington, Barnes, Kisselle, Learman & McCulloch, P.C.

[57] ABSTRACT

A carburetor having an idle nozzle and a main nozzle each with a fixed flow area and an idle speed single adjustment screw adjustable by the user. The idle and high speed fuel flows are controlled by the idle nozzle and the main nozzle, respectively. The user can adjust the engine speed only by adjustment of the idle speed adjustment screw which changes the position of the carburetor throttle valve to control the flow through the carburetor. This provides a more consistent fuel and air mixture to improve the performance of the engine and better control engine emissions by preventing the user from changing the fuel and air ratio to a mixture which is either too lean or too rich for the steady and low level exhaust emission operation of the engine.

14 Claims, 2 Drawing Sheets

SINGLE SCREW CARBURETOR

FIELD OF THE INVENTION

This invention relates generally to fuel delivery systems for internal combustion engines and more particularly to an improved carburetor.

BACKGROUND OF THE INVENTION

Carburetors are widely used to produce and control the mixture of fuel and air delivered to an operating engine. Current carburetors utilize one or more needle valve assemblies to meter the quantity of fuel in the fuel and air mixture. The needle valve assemblies have a pin or needle threadably received in a bore of the carburetor and rotatable to vary the location of a conical end of the needle relative to an annular seat to vary and control the area between the needle and the seat through which fuel flows. One of the major problems with needle valve assemblies is that a fuel flow change can and usually does occur after the needle valve assembly has been adjusted. This fuel flow change is caused by axial and radial movement after adjustment of the conical tip of the needle relative to the seat which may be caused by vibrations, temperature changes, installation of a limiting cap and other physical side loading of the needle. Radial movement of the needle relative to the valve seat decreases the gap between the needle and the valve seat adjacent one portion of the needle and increases the gap on the opposite portion of the needle which can drastically affect the fuel flow characteristics through the needle valve assembly.

Another problem with the needle valve assemblies is the size of the metering orifice. The annular fuel flow area between the needle and valve seat is generally on the order of about 0.001 inches to 0.002 inches wide. Most particles such as dirt or aluminum flakes within the carburetor are too large to pass through this gap and may at least partially clog the fuel flow area causing the engine to run leaner than desired.

Also, to limit the extent to which the end user can vary the fuel flow rate through a needle valve assembly, a limiter cap or the like has to be installed on the needle to limit the extent to which it can be rotated. These limiter caps increase the cost to manufacture and assemble the needle valve assemblies and may cause the needle valve to shift relative to its seat as the caps are installed after adjustment and thereby unintentionally alter the fuel flow rate of the valve assembly.

Additionally, current carburetors typically have at least a low fuel mixture needle valve, a high fuel mixture needle valve and an idle air adjustment screw. Adjustment of these components permits calibration or tuning of the carburetor to provide a fuel and air mixture to the engine at speeds ranging from idle speed to wide open throttle. However, adjustment of the carburetor is relatively complex and difficult for unskilled power equipment operators. When the user adjusts the idle or the high mixture needle, the fuel flow will change to either a richer or a leaner condition. Resulting from this mixture change, undesirable engine performance may occur such as acceleration lag, under running during deceleration, instability of the engine at idle speeds, increased exhaust emissions, and improper or less than optimum fuel to air ratios and engine performance.

SUMMARY OF THE INVENTION

A single screw carburetor is provided having an idle nozzle and a main nozzle each with a fixed flow area and an idle speed adjustment screw adjustable by the user. The idle and high speed fuel flows are controlled by the idle nozzle and the main nozzle, respectively. The user can adjust the engine speed only by adjustment of the idle speed adjustment screw which changes the position of the carburetor throttle valve to control the air flow through the carburetor. This provides a more consistent fuel and air mixture to improve performance of the engine and better control engine emissions by preventing the user from changing the fuel and air mixture ratio to a mixture which is either too lean or too rich for the optimum operation of the engine.

The single screw carburetor facilitates adjustment of the engine idle speed by the user and eliminates the complex calibration of carburetors having needle valve assemblies and the subsequent fuel flow changes which occur in use of the needle valve assemblies after calibration. Further, the limited idle speed adjustment permitted by the user prevents the user from adjusting the carburetor so that the engine runs too lean or too rich and maintains the engine emissions within the limits set by current emissions legislation. In this way, the carburetor is inherently tamper-proof Further, the idle nozzle and main nozzle may be machined orifices directly in the carburetor body or they may be separate inserts fitted into bores in the carburetor. This reduces the number of parts of the carburetor as compared to carburetors utilizing needle valve assemblies and, therefore, the cost to manufacture and assemble this single screw carburetor is reduced.

Objects, features and advantages of this invention include providing a carburetor which facilitates adjustment of the idle speed by the operator, eliminates adjustment by the operator of the fuel to air ratio, eliminates the use of needle valve assemblies, reduces the number of parts in the carburetor, provides a generally fixed fuel to air ratio of the mixture delivered to the engine, assures stable engine performance, easily meets the tamper resistant requirements of current emissions legislation, provides a consistent fuel flow from one carburetor to another, is of relatively simple design and economical manufacture and assembly, and has a long, useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENT

Figure 1:
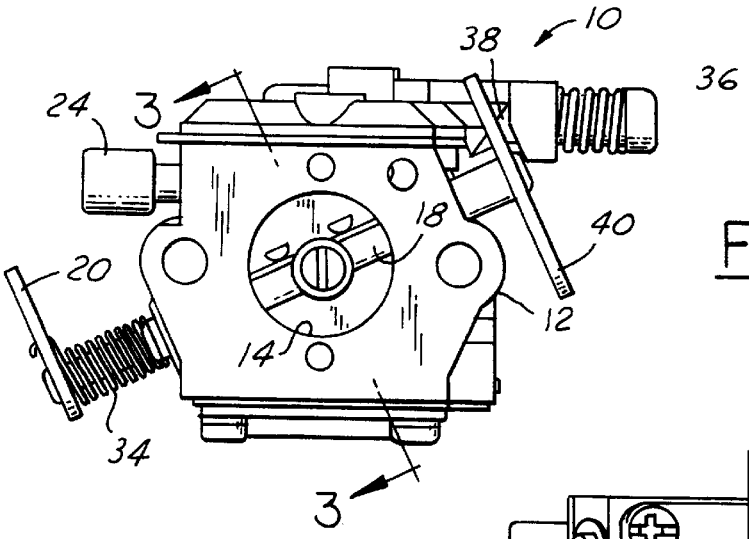
FIG. 1 is an end view of a carburetor embodying the invention.
Figure 2:
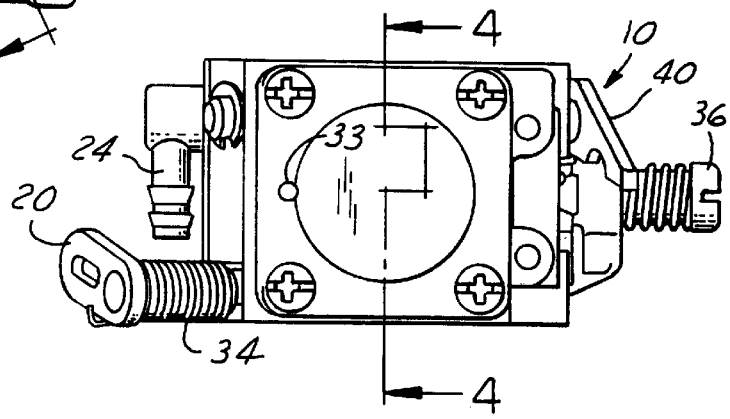
FIG. 2 is a bottom view of the carburetor of FIG. 1.

Referring in more detail to the drawings, FIGS. 1 and 2 illustrate a carburetor 10 having a main body 12 with a mixing passage 14 in which a throttle valve 16 is mounted on a shaft 18 rotatable by a lever 20. A fuel pump 22 in the body 12 receives fuel from a fuel inlet 24 and delivers fuel to a chamber 26 through an inlet valve (not shown) controlled by a fuel metering diaphragm 28 such as shown and described in U.S. Pat. No. 5,262,092, the disclosure of which is incorporated herein by reference in its entirety. Generally, the fuel chamber 26 is defined between one side of the diaphragm 28 and the main body 12 of the carburetor 10 and an air chamber 30 is defined between the other side of the diaphragm 28 and a cover plate 32. Preferably, the air chamber 30 communicates with the atmosphere through a hole 33 in the cover plate. The diaphragm 28 is responsive to a differential pressure across the diaphragm 28 to actuate a valve assembly (not shown) to control the delivery of fuel from the fuel pump 22 to the fuel chamber 26.

Figure 3:
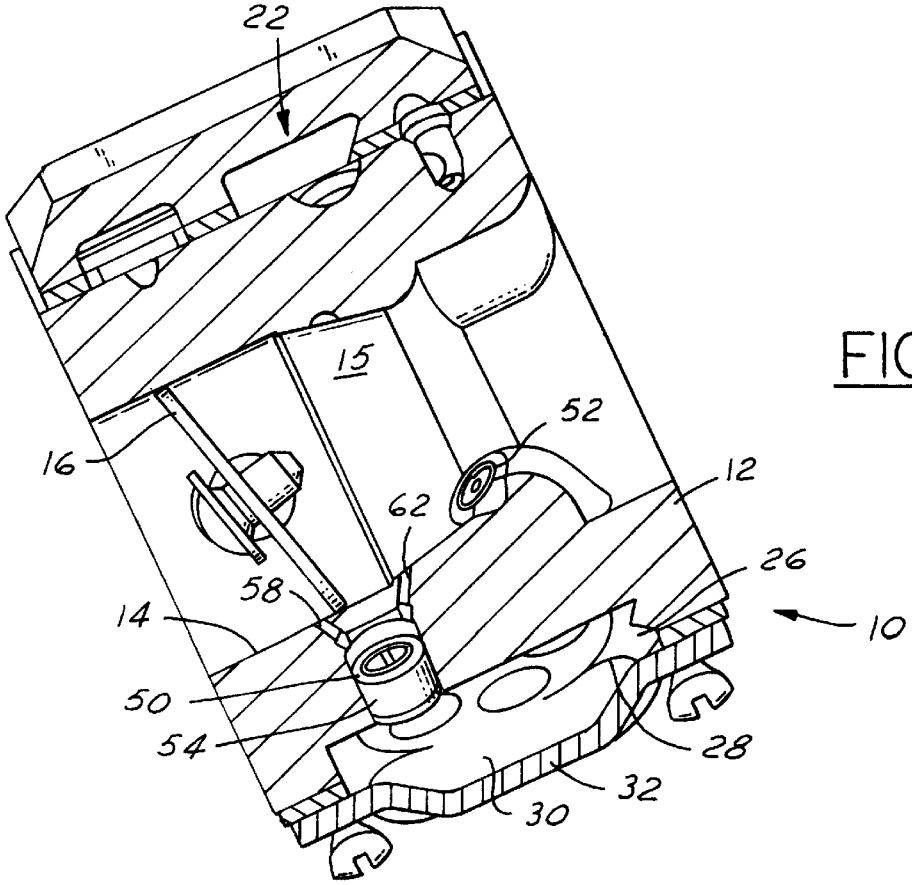
FIG. 3 is a cross sectional view taken along line 3—3 of FIG. 1.
Figure 4:
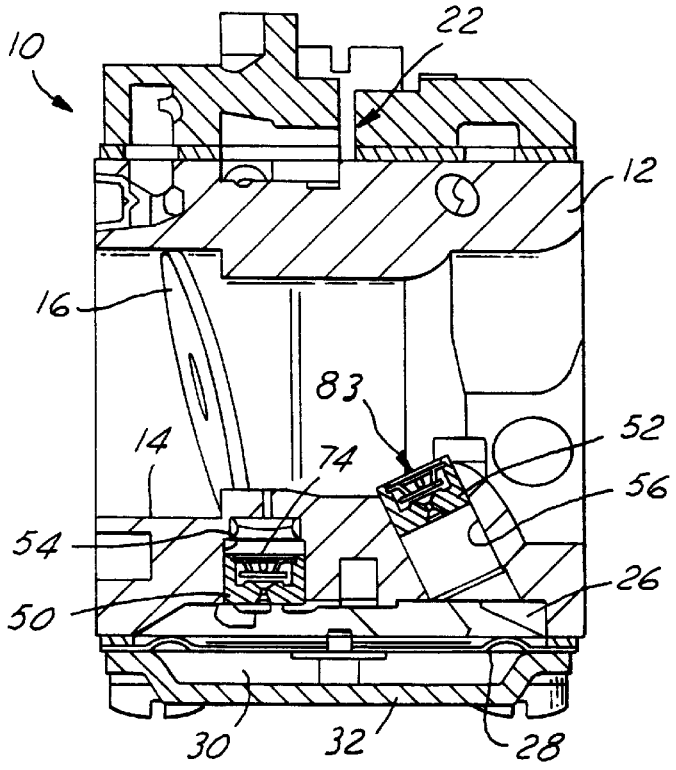
FIG. 4 is a cross sectional view taken along line 4—4 of FIG. 2.

As shown in FIGS. 3 and 4, the mixing passage 14 may have a venturi shape with a reduced diameter central portion or throat 15 in which a pressure drop is created by air flow through the mixing passage 14. Air flow through the mixing passage 14 is controlled by the throttle valve 16. The throttle valve 16 is rotated in the mixing passage 14 between a first position substantially closing and generally transverse to the axis of the mixing passage 14 and a second, fully open position generally parallel to the axis of the mixing passage 14 and permitting a substantially unrestricted flow of air through the mixing passage 14. The first position of the throttle valve 16 corresponds to engine idle speed and the second position corresponds to what is commonly referred to as "wide open throttle". Desirably, a spring 34 yieldingly biases the throttle lever 20 and hence, biases the throttle valve 16 to its idle position.

An idle speed adjustment screw 36 is threadably received in the carburetor body 12 and has a conical tip 38 on its free end. The tip 38 provides an adjustable stop engaged by an arm 40 attached to one end of the throttle valve shaft 18 when the throttle valve 16 is in its first or idle position. Rotation of the idle speed adjustment screw 36 changes the location of the tip 38 relative to the arm 40 to change the position at which the arm 40 bears on the tip 38 and thereby adjusts the first position of the throttle valve 16 and hence the idle speed of the operating engine.

Liquid fuel in the fuel chamber 26 is supplied to a low speed or idle nozzle 50 and a high speed or main nozzle 52 received in passages 54 and 56 formed in the main body 12. The idle nozzle 50 communicates with the mixing passage 14 through three separate passages 58, 60, 62. The first passage 58 opens into the mixing passage 14 downstream of the throttle valve 16 when it is in its first or idle position. Second and third passages 60, 62 open into the mixing passage 14 upstream of the throttle valve 16 when it is in its first or idle position. The main nozzle 52 preferably communicates directly with the mixing passage upstream of the throttle valve 16.

Figure 5:
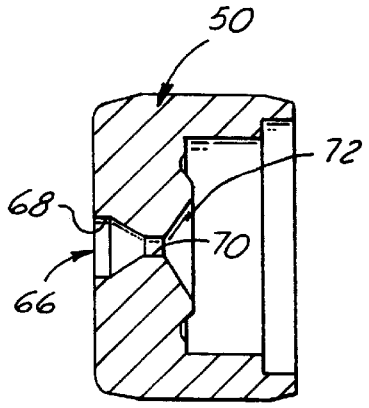
FIG. 5 is a cross sectional view of an idle nozzle without a check valve.

As best shown in FIGS. 4 and 5, the idle nozzle 50 is preferably an insert fitted into the passage 54 and has a fuel passage 66 formed therethrough and having an inlet end 68 leading to a tapered or venturi portion 70 which opens into an outlet 72 of the passage 66. Alternatively, the idle nozzle may be an orifice machined directly in the carburetor body 12. If desired, a check valve 74 (FIG. 4) may also be provided adjacent the outlet of the passage 66 to facilitate purging of air from the carburetor to improve starting of the engine and to prevent reverse fuel flow through the idle nozzle.

Figure 6:
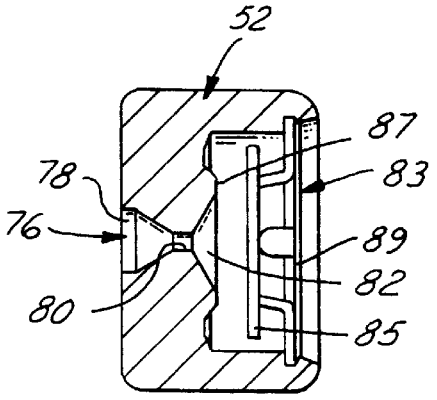
FIG. 6 is a cross sectional view of a main fuel nozzle.

As best shown in FIGS. 4 and 6, the main nozzle 52 is an insert fitted into the passage 56 which is in communication with the mixing passage 14 upstream of the throttle valve 16. The main nozzle 52 has a passage 76 formed therethrough having an inlet end 78 leading to a tapered or venturi portion 80 which opens into an outlet side 82 of the nozzle 52 Alternatively, the main nozzle 52 may be an orifice machined directly in the carburetor body 12. The main nozzle 52 may be of substantially any configuration sufficient to provide the desired fuel flow characteristics therethrough. A check valve 83 is provided adjacent the main nozzle outlet 82 to prevent reverse fluid flow from the mixing passage 14 through the main nozzle 52. The check valve is preferably carried by the main nozzle as shown in FIG. 6 and has a valve disc 85 which bears on an annular valve seat 87 to close the main nozzle 52. A perforate retainer 89 limits the displacement of the valve disc 85 from the valve seat 87 when fuel and/or air are discharged from the main nozzle 52 into the mixing passage 14. Such a check valve 83 prevents reverse flow through the main nozzle 52 and removal of fuel from the main circuit during engine idle and slightly open throttle conditions.

Figure 7:
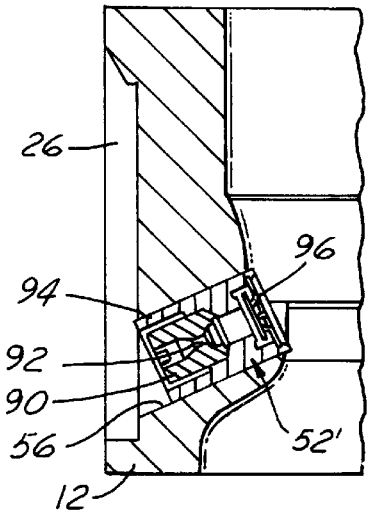
FIG. 7 is a cross sectional view of a modified main nozzle.

In another embodiment, the idle and main nozzles 50, 52 may be threadably received in tapped bores in the carburetor body 12 or in separate inserts themselves fitted in the carburetor body. For example, as shown in FIG. 7, a main nozzle assembly 52' has a body 90 with a fixed orifice 92 threadably received in a retainer 94 press fit in the passage 56 of the carburetor body 12. A check valve 96 is preferably carried by the retainer 94.

Operation

When the engine is idling, the throttle valve 16 is in its first position substantially restricting the flow of air through the mixing passage 14. The low air flow velocities upstream of the throttle valve 16 are not sufficient to induce fuel flow from the main nozzle 52. The first passage 58 communicating with the idle nozzle 50 is subjected to a vacuum or a pressure drop caused by the cranking of an operating engine. As a result thereof, the passage 54 containing the idle nozzle 50 receives fuel from the fuel chamber 26 which flows through the idle nozzle 50, the first passage 58 and into the mixing passage 14 whereupon the fuel is combined with air and the fuel and air mixture is delivered to the operating engine.

When the engine throttle lever 20 is moved to cause an increased engine operating speed, the throttle valve 16 is rotated within the mixing passage 14. As viewed in FIG. 3, the throttle valve 16 rotates counterclockwise from its first position toward its second or wide open throttle position. As the throttle valve 16 initially opens, fuel is supplied to the mixing passage through both the first passage 58 and at least the second passage 60 and usually the third passage 62 which function as acceleration ports to provide additional fuel to the mixing passage 14 as the engine is accelerated from an idle or low operating speed to a higher operating speed. When the throttle valve 16 is opened sufficiently towards its wide open throttle position, an increased pressure drop is produced at the main nozzle 52. This pressure drop at the main nozzle 52 draws fuel from the fuel chamber 26 through the main nozzle 52 for delivery into the air stream flowing through the mixing passage 14 to provide a fuel and air mixture to the operating engine.

The passages 66, 76 formed through the idle nozzle 50 and the main nozzle 52 are constructed to provide a metered flow of fuel into the mixing passage 14 to provide the desired fuel to air mixture ratio as desired for the operation of the engine. Desirably, this fuel to air mixture ratio remains essentially constant throughout use of the carburetor 10 and is within acceptable limits to provide stable engine performance and acceptable exhaust emissions levels from the operating engine. Therefore, with the fixed orifice idle and main nozzles 50, 52, the carburetor 10 according to this invention provides a desirable fuel to air ratio mixture to an operating engine over engine speeds ranging from idle to wide open throttle. Desirably, this fuel to air ratio of the mixture cannot be altered by the user and does not require high and low fuel mixture needle valve assemblies which are difficult to calibrate or adjust, and which are subject to becoming clogged or displaced to provide inconsistent fuel flow rates therethrough in use.

The only adjustment which can be made externally of the carburetor 10 by the user is to the idle speed adjustment screw 36 which permits slight variation of the first position of the throttle valve 16 to vary and adjust the engine idle speed. This adjustment of the screw 36 permits the user to control the speed at which the engine idles by changing the first position of the throttle valve 16 to control the air flow and thus the rate of flow of fuel drawn through the idle nozzle 50 and into the mixing passage 14. Thus, with a single adjustment screw 36, the user can control the idle speed of the engine to provide for the stable operation of the engine. The fuel to air mixture ratio remains generally constant and cannot be altered by the user. Thus, the carburetor 10 eliminates the complex adjustments associated with multiple needle valve assemblies and the engine performance and emission problems associated with improper carburetor adjustment made by the user.

The carburetor 10 according to this invention has relatively few parts, is easy to adjust by the end user, is tamper-proof and provides an essentially constant fuel to air ratio mixture sufficient for the stable operation of the engine. Further, the carburetor 10 according to this invention is extremely versatile in that interchangeable idle nozzles 50 and main nozzles 52 of different sizes may be inserted into the carburetor main body 12 to change the fuel flow characteristics of the carburetor 10 so that the carburetor 10 may be used with different engines.

What is claimed is:

1. A carburetor for delivering a metered fuel and air mixture to an engine comprising:

a main body;

a mixing passage formed through the main body;

a throttle valve carried by the main body and constructed to control the fluid flow through the mixing passage, the throttle valve being movable in the mixing passage between first and second positions;

an idle speed adjustment screw carried by the main body and adjustable to control the idle position of the throttle valve;

an idle nozzle carried by the main body in communication with the mixing passage and having a restricted fixed orifice constructed to supply a metered quantity of fuel to the engine at least when the engine is operating at low speeds;

a main nozzle carried by the main body in communication with the mixing passage and having a restricted fixed orifice constructed to supply a metered quantity of fuel to the engine at least when the engine is operating at high speeds; and the quantity of fuel supplied to the idle and main nozzles is not adjustable and cannot be changed by the user to change the fuel to air ratio of the fuel and air mixture supplied to an engine by the carburetor; whereby the fixed orifices of the idle nozzle an main nozzle control the flow rate of fuel into the mixing passage in response to air flow through the mixing passage to provide a metered fuel and air mixture to the engine.

2. The carburetor of claim 1 wherein the idle nozzle and main nozzle are separate orifices formed in the main body.

3. The carburetor of claim 1 wherein the fixed orifice of the idle nozzle is in an insert fitted into a bore in the main body.

4. The carburetor of claim 1 wherein the fixed orifice of the main nozzle is in an insert fitted into a bore in the main body.

5. The carburetor of claim 1 wherein the throttle valve is rotatable between a first position substantially restricting fluid flow through the mixing passage which corresponds to engine idle speed and a second position permitting fluid flow generally unrestricted by the valve through the mixing passage, and adjustment of the idle speed screw changes the angular position of the throttle valve in its first position.

6. The carburetor of claim 5 which also comprises a shaft carried by the main body and operably connected to the throttle valve, an arm operably coupled to the shaft and a tapered tip of the idle speed adjustment screw engageable with the arm to determine the first position of the throttle valve.

7. The carburetor of claim 1 wherein the idle nozzle is in communication with the mixing passage downstream of the throttle valve when the throttle valve is in its first position.

8. The carburetor of claim 7 wherein the idle nozzle is also in communication with the mixing passage upstream of the throttle valve when the throttle valve is in its first position.

9. The carburetor of claim 1 wherein the main nozzle is in communication with the mixing passage upstream of the throttle valve.

10. The carburetor of claim 1 which also comprises a check valve disposed between the idle nozzle and the mixing passage and constructed to prevent reverse fluid flow through the idle nozzle.

11. The carburetor of claim 10 wherein the check valve is carried by the idle nozzle.

12. The carburetor of claim 1 which also comprises a check valve disposed between the main nozzle and the mixing passage and constructed to prevent reverse fluid flow through the main nozzle.

13. The carburetor of claim 12 wherein the check valve is carried by the main nozzle.

14. A carburetor for delivering a metered fuel and air mixture to an engine comprising:

a main body;

a mixing passage through the main body;

a throttle valve carried by the main body and constructed to control the flow of fluid through the mixing passage, the throttle valve being movable in the mixing passage between a first idle position and a second wide open throttle position;

an idle adjustment screw carried by the main body and adjustable to adjust and control the idle position of the throttle valve;

an idle nozzle carried by the main body in communication with the mixing passage, a restricted fixed orifice constructed to be the sole supply of a metered quantity of fuel through the idle nozzle into the mixing passage and the engine at least when the engine is operating at low speeds;

a main nozzle carried by the main body in communication with the mixing passage, a restricted fixed orifice constructed to be the sole supply of a metered quantity of fuel to the main nozzle into the mixing passage and the engine at least when the engine is operating at high speeds; and the carburetor not having any valve assembly to adjust the quantity of fuel supplied to the idle and main nozzles so that a user cannot change the fuel to air ratio of the fuel and air mixture supplied through the mixing passage to the engine by the carburetor; whereby the restricted fixed orifices of the idle nozzle and main nozzle solely control the flow rate of fuel into the mixing passage in response to air flow through the mixing passage to provide a metered fuel and air mixture to the engine.

* * * * *

UNITED STATES PATENT AND TRADEMARK OFFICE

CERTIFICATE OF CORRECTION

PATENT NO. : 6,123,322
DATED : September 26, 2000
INVENTOR(S) : Hidenori Sasaki

It is certified that error appears in the above-identified patent and that said Letters Patent is hereby corrected as shown below:

Column 5,
Line 53, delete "an" and insert -- and --.

Signed and Sealed this

Twenty-sixth Day of February, 2002

*Attest:*

*Attesting Officer*

JAMES E. ROGAN
*Director of the United States Patent and Trademark Office*